US009528533B2

(12) United States Patent
Herrmann

(10) Patent No.: US 9,528,533 B2
(45) Date of Patent: Dec. 27, 2016

(54) LIFTING PLATFORM WITH HYDRAULIC COUPLING OF THE LIFTING RAMS

(71) Applicant: HERRMANN AG, Poesing (DE)

(72) Inventor: Johannes Herrmann, Poesing (DE)

(73) Assignee: HERRMANN AG (DE)

( * ) Notice: Subject to any disclaimer, the term of this patent is extended or adjusted under 35 U.S.C. 154(b) by 331 days.

(21) Appl. No.: 14/250,232

(22) Filed: Apr. 10, 2014

(65) Prior Publication Data

US 2014/0311335 A1 Oct. 23, 2014

(30) Foreign Application Priority Data

Apr. 17, 2013 (DE) ..... 10 2013 103 861

(51) Int. Cl.

| | |
|---|---|
| ***F15B 15/02*** | (2006.01) |
| ***B66F 3/26*** | (2006.01) |
| ***B66F 3/46*** | (2006.01) |
| ***B66F 7/20*** | (2006.01) |

(52) U.S. Cl.

CPC ..... *F15B 15/02* (2013.01); *B66F 3/26* (2013.01); *B66F 3/46* (2013.01); *B66F 7/20* (2013.01)

(58) Field of Classification Search

CPC ..... B66F 3/24; B66F 3/46; B66F 7/20

See application file for complete search history.

(56) References Cited

FOREIGN PATENT DOCUMENTS

| | | | |
|---|---|---|---|
| DE | 1157486 | 11/1963 | ..... B30B 15/24 |
| DE | 35 544 | 11/1965 | |
| DE | 2523184 | 12/1976 | ..... B66F 3/46 |
| DE | 2523184 A * | 12/1976 | |
| DE | 3544238 | 6/1987 | ..... B66F 7/20 |
| JP | S58152797 | 9/1983 | ..... B66F 3/46 |
| WO | WO 95/11189 | 4/1995 | ..... B66F 7/20 |
| WO | WO 2012150753 | 11/2012 | ..... B66F 3/30 |

OTHER PUBLICATIONS

Extended European Search Report (no translation) issued in related application No. 14164969.9, dated Sep. 5, 2014 (9 pgs).

German Search Report issued in related German Patent Appln. No. 10 2013 103 861.1 dated Apr. 4, 2014 (5 pgs).

* cited by examiner

*Primary Examiner* — Thomas E Lazo

(74) *Attorney, Agent, or Firm* — Hayes Soloway P.C.

(57) ABSTRACT

An apparatus for lifting motor vehicles includes a first lifting device which is movable in a vertical direction and which is suitable for supporting a first region of the motor vehicle to be lifted, and a second lifting device which is arranged at a distance from the first lifting device and which is suitable for supporting a second region of the motor vehicle to be lifted. A first supply line supplies an hydraulic medium to the first lifting device, and with a second supply line supplies an hydraulic medium to the second lifting device.

21 Claims, 6 Drawing Sheets

LIFTING PLATFORM WITH HYDRAULIC COUPLING OF THE LIFTING RAMS

BACKGROUND OF THE INVENTION

The present invention relates to a lifting device for lifting articles and, in particular, motor vehicles, and in particular to a lifting platform. Lifting platforms of this type are known from the prior art. These lifting platforms in this case usually have one or more lifting devices which have elements which are movable in a vertical direction and upon which a motor vehicle is positioned in order to be lifted in this way. In particular, multiple-ram lifting platforms, which lift the motor vehicle with a plurality of lifting devices or lifting rams respectively arranged at a distance from one another, are known in this case from the prior art. It is usual in this case for these lifting devices to have arranged between them rigid cross members and/or articulated cross members which ensure that the two lifting devices move upwards or downwards simultaneously. During operation, however, these cross members can be intrusive.

The object of the present invention is therefore to make available a lifting platform which can dispense with a mechanical coupling of this type between the lifting devices.

SUMMARY OF THE INVENTION

An apparatus according to the invention for lifting motor vehicles has a first lifting device which is movable in a vertical direction (or by which at least one element is movable in the vertical direction respectively) and which is suitable for supporting at least one first region of the vehicle to be lifted. In addition, a second lifting device is provided which is arranged at a distance from the first lifting device and which is suitable for supporting a second region of the motor vehicle to be lifted. In this case at least one element of this second lifting device is also movable in the aforesaid vertical direction.

In addition, a first supply line is provided which supplies an hydraulic medium to the first lifting device, as well as a second supply line which supplies an hydraulic medium to the second lifting device.

According to the invention the first lifting device has a first supply element arranged in a stationary manner for supplying the hydraulic medium into the lifting device, this first supply element extending at least locally in the vertical direction (or generally in the lifting direction of the lifting device, which, although vertical as a rule, can also deviate from the vertical direction by a few degrees) and this supply element having a first duct for conveying the hydraulic medium. In addition, the first lifting device has a first lifting element which extends in the vertical direction and which is movable with respect to the first supply element in this vertical direction.

Furthermore, the second lifting device has a first supply element arranged so as to be stationary for supplying the hydraulic medium, this first supply element of the second lifting device extending at least locally in the vertical direction and this second supply element also having a first duct for conveying the hydraulic medium, and the second lifting device furthermore having a first lifting element which extends in the vertical direction and which is movable with respect to the first supply element in this vertical direction.

In addition, the apparatus has a first connecting line which forms a flow connection for the hydraulic medium between the first lifting device and the second lifting device.

It is therefore proposed that the two aforesaid lifting devices should be supplied in each case with the hydraulic medium and, in addition, should be connected to each other by way of a connecting line. By means of this connecting line a coupling (hydraulic) or a synchronization respectively between the two lifting devices can be produced by way of the hydraulic medium, without the two lifting devices having to be connected to each other mechanically for this purpose.

In this case it is possible for the lifting platform to be a so-called underfloor lifting platform, in which the supply elements are arranged below ground at least in part. It would also be possible, however, for above-ground lifting platforms to be used.

In the case of a further advantageous embodiment valve devices can be provided which control the fluid communication with the lifting devices and optionally also between the two lifting devices.

Lifting members which are capable of being positioned below the vehicle can be additionally arranged on the lifting element or the lifting elements respectively. In this case it is possible for carrying arms to be provided on which these lifting members in turn are arranged in order to support the vehicle. In addition, measuring devices which determine a weight force of the motor vehicle can be provided on the respective carrying arms or the support elements respectively. In this case a measuring device of this type can be associated in each case with each of these lifting members.

In the case of a further advantageous embodiment the first connecting line is used to effect a coupling of the movements of the first lifting device and the second lifting device in the vertical direction. In addition, however, further elements can also be used for this coupling.

It is advantageous for the apparatus to have a second connecting line which forms a flow connection for the hydraulic medium between the first lifting device and the second lifting device. In this way, it is preferable for two connecting lines to be provided between the two lifting devices. It is advantageous for these two connecting lines to be completely separate from each other. In this case one connecting line can serve as a redundant safety system for the other connecting line.

In this case it is possible for the drive between the lifting devices to act in advance as a whole as a so-called master/slave drive, in which one of the two lifting devices pre-sets the movement and the other lifting device follows this movement. In addition, a central or separate supply line can be provided which first supplies the hydraulic medium to the two lifting devices.

It is advantageous for each lifting device to have at least two supply elements. In this case a first supply element of the first lifting device can preferably be connected in terms of (hydraulic) flow to a second supply element of the second lifting device by way of a first connecting line, and the first supply element of the second lifting device can preferably be connected in terms of (hydraulic) flow to the second supply element of the first lifting device.

In this case the two supply elements of the two lifting devices can be designed in a similar manner, but it would be possible for them to behave differently, in particular with respect to the flow directions of the hydraulic medium. In this way, it would be possible, in order to lift the vehicle, for the hydraulic liquid in a first supply element to flow upwards in each case in a first duct of this supply element, while in the second supply element no flow or a flow in a different direction is present at the same time.

In the case of a further advantageous embodiment at least one supply element has a supply opening for supplying the hydraulic medium to the supply element, this supply opening being arranged in a lower half of the supply element. It is advantageous for this supply opening to be arranged in a lower third, preferably in a lower quarter, and in a particularly preferred manner in a lower fifth of the supply element. In this way, it can be made possible for the aforesaid supply openings or lines arriving at these supply openings respectively not to obstruct the movement of the lifting element.

It is advantageous for all the openings by way of which the supply element is connected in terms of flow to further devices to be arranged in a lower region of the supply element.

In the case of a further advantageous embodiment a further opening is provided, likewise in a lower region, in order to remove the medium, for example to the other lifting device. In this case it would be possible, in particular in the case of underfloor lifting platforms, for attachment parts to be provided which are situated for example in or under a floor region of the lifting platforms and for attached pipe lines to extend to the respective supply openings.

In the case of a further advantageous embodiment the supply element is arranged inside the lifting element associated with it. In this way, as a result of stressing with the hydraulic medium a relative movement can be produced between the supply element and the lifting element, or in more precise terms a movement of a lifting element with respect to the supply element.

As mentioned above, the supply element is arranged in this case so as to be stationary, for example on a floor or on a carrier, and it acts upon a portion of the interior of the lifting element, as a result of which this lifting element is caused to be lifted.

It is advantageous for a variable volume for lifting the lifting device or the lifting element respectively to be arranged between the supply element and the lifting element. This variable volume can be acted upon with the hydraulic medium.

In the case of a further advantageous embodiment a second liquid duct for conveying the hydraulic medium is arranged in at least one supply element. It is advantageous for at least one second liquid duct for conveying the hydraulic medium to be provided in a plurality of supply elements, and in a particularly preferred manner in all the supply elements.

In this case it is possible for the two liquid ducts to extend parallel to each other. In this case it would be possible for the first supply duct to be arranged for example in a central region of the supply element and for at least one further liquid duct to surround this first liquid duct. In addition, it would be possible for a plurality of second liquid ducts of this type to be arranged around the first liquid duct.

In the case of a further advantageous embodiment the hydraulic medium is capable of being conveyed in the first liquid duct and the second liquid duct in different directions of flow. In particular, these are opposed conveying directions. It is advantageous for the two directions to be vertical directions in each case.

Furthermore, a reversing duct can be provided, which reverses the hydraulic medium in the flow direction thereof. In this case it would be possible for the supply element to be acted upon from below with the hydraulic medium, for the latter first to flow upwards, to be reversed there and to flow downwards again by way of the second liquid ducts. It is advantageous for a liquid volume for lifting the lifting element to be formed above the first supply element. In the case of a further advantageous embodiment a plurality of first supply elements are provided, and in particular a plurality of first supply elements are provided inside a lifting element. In this way, it is possible for two supply elements of this type to be connected in series with respect to the direction of flow of the hydraulic medium, but it would also be possible for supply elements to be connected in parallel with each other.

In addition, it would also be possible for three and preferably four supply elements of this type to be provided in each lifting device. In this case these can also be connected in series or, for example, two of these four can be connected in series and these in turn can be connected in parallel with the other two supply elements. In this way, a redundancy can be achieved on the one hand and the hydraulic effect can be distributed to a plurality of supply elements on the other hand.

The present invention further relates to a lifting device, in particular, for a lifting platform, and in particular a lifting platform of the type described above. This lifting device has a first supply element for supplying the hydraulic medium to the lifting device, this first supply element extending at least locally in a straight direction and this supply element having a first duct for conveying the hydraulic medium. Furthermore, the lifting device has a first lifting element which likewise extends in the aforesaid straight direction and which is movable with respect to the first supply element in this straight direction, the first supply element having a first connection for supplying the hydraulic medium to the first duct and the supply element being arranged at least locally inside the lifting element.

According to the invention the first supply element has a second duct for conveying the hydraulic medium, this second duct being separate from the first duct (at least locally and preferably in the entire longitudinal extension of the ducts) and the lifting device further being designed in such a way that the hydraulic medium is capable of being conveyed in opposed directions of flow in these ducts.

In this way, the lifting device also makes it possible for the hydraulic medium to be capable of being supplied for example in a lower region and nevertheless for no connections or the like to have to be provided in the upper region of the lifting device for the reversing.

It is preferable for the lifting device to have at least one second supply element which extends preferably parallel to the first supply element and which preferably is likewise arranged inside the lifting element. It is also preferable for at least one duct and preferably a plurality of flow ducts, inside which the hydraulic medium can flow, to be arranged in this second supply element. In this case it is possible for a closure device to prevent at least in part a flow of the hydraulic medium in one of these ducts. Furthermore, it is preferable for at least one flow or hydraulic connection to be provided between the two supply elements.

It is preferable for the lifting device to have a housing, inside which the lifting element is arranged, a first guide device being further provided in order to guide the movement of the lifting element with respect to the housing as well as preferably a second guide device in order to guide the movement of the lifting element with respect to the housing, and these two guide devices are arranged at a distance from each other in the direction of movement of the lifting element with respect to the housing. In this case it is possible for these two guide devices to be arranged at opposite ends of the lifting device in a first state of the lifting device, for example in a completely retracted state of the lifting element.

In the case of a further advantageous embodiment the housing has a polygonal, and in particular a rectangular and in particular a square, cross-section. It is advantageous for the lifting element to have a circular cross-section.

In the case of a further advantageous embodiment at least one guide device is also designed in the form of a rotation prevention means, which prevents rotation of the lifting element with respect to the housing, in particular preferably in the aforesaid longitudinal direction or the direction of movement with respect to the housing.

In the case of a further advantageous embodiment at least one guide device is arranged on the lifting device and thus moves with it. It is advantageous for a second guide device to be arranged on the housing and to be formed for example by a circular opening cross-section, with respect to which the lifting element moves. It is advantageous for the guide device arranged on the lifting element to be designed in such a way that it projects beyond the lifting element in a direction at a right angle to the movement and that, in particular, it has a cross-section in this case which deviates from a circular cross-section. In particular, this guide device has a cross-section which is adapted to an internal cross-section of the housing, so that in this way a guidance is achieved.

In the case of a further advantageous embodiment the lifting element is designed with a substantially closed peripheral wall and a cover which closes the lifting element in one direction (in particular in a fitted state) at the top and, in particular, also closes it in a gas-tight and/or liquid-tight manner.

In the case of a further advantageous embodiment the rotation prevention means has a polygonal cross-section, and in particular a square or rectangular cross-section. In this case the rotation prevention means can be provided in the corner elements with guide members in each case which slide with respect to an inner wall of the housing.

In the case of a further advantageous embodiment the guide device has a braking and/or blocking element which brakes and/or blocks a relative movement of the lifting element with respect to the supply element. It is advantageous for this braking and/or blocking element to be arranged in this case on the guide device and thus preferably on the lifting element. This braking and/or blocking element can advantageously produce a blocking or braking action by stressing with a force, for example a magnetic, hydraulic, pneumatic or mechanical force, also a mechanical force. In this case it would be possible for there likewise to be provided a blocking permitting member which is arranged so as to be stationary and which for example can have a plurality of openings into which an element of the blocking device can engage for blocking purposes. This is explained in greater detail with reference to the figures.

The present invention further relates to a supply element, in particular, for a lifting device of the type described above. This supply element has in this case an elongate body which in its interior forms a first duct as well as also at least one second duct.

These ducts advantageously extend in this case in a longitudinal direction, and in a particularly preferred manner in a straight line. Furthermore, the supply element has fastening means in order to be able to be fastened to an underlying surface, for example a floor. In addition, it is preferable for the supply element to have a central line as well as a plurality of further lines arranged around this central line. It is advantageous for the supply element to be an extruded body.

In the case of a further advantageous embodiment the apparatus has at least one aeration device and, in particular, at least one aeration valve for the aeration of at least one of the aforesaid ducts. In this case it is pointed out that, in particular, the second duct mentioned above for the aeration is accessible only with difficulty. It is preferable for this aeration valve to be arranged inside the lifting element. It is preferred for the aeration valve to be arranged between an end portion of the second duct or the supply element respectively and a closure of the lifting element. In this case this aeration valve can have a spring device, and it allows the valve to be opened in a pre-set position of the lifting device, for example in a completely retracted position. The aforesaid spring device can act in this case upon a movable valve member which causes the opening and closing of the valve. In this way, it is advantageous for the aeration valve to be capable of being switched by a movement of the lifting element with respect to the supply element.

Furthermore, the aeration valve can also have an aeration duct which can remove air from the at least one duct.

It is pointed out that the aeration valve described here can also be used with lifting devices known from the prior art in a manner independent of the above inventions. The Applicants therefore retain the right also to apply for a separate protection for an aeration valve of this type and/or for the use thereof in a lifting device.

The present invention further relates to a method of lifting objects, and in particular motor vehicles. In this case a force is exerted by way of a first lifting device upon a first region of the vehicle to be lifted, and a force is exerted by a second lifting device upon a second region of the motor vehicle to be lifted. In this case the two lifting devices are arranged at a distance from each other. According to the invention, in order to lift the motor vehicle, the two lifting devices are acted upon with an hydraulic medium, and in addition a fluid communication is also possible between these two lifting devices in order to couple the movement of the first lifting device to the movement of the second lifting device hydraulically in this way, in particular without a mechanical connection between the two lifting devices. In this case it is also possible for the two lifting devices to be arranged inside stationary housings in each case.

BRIEF DESCRIPTION OF THE DRAWINGS

Further advantages and embodiments are evident from the accompanying drawings. In the drawings

DETAILED DESCRIPTION OF THE INVENTION

Figure 1:
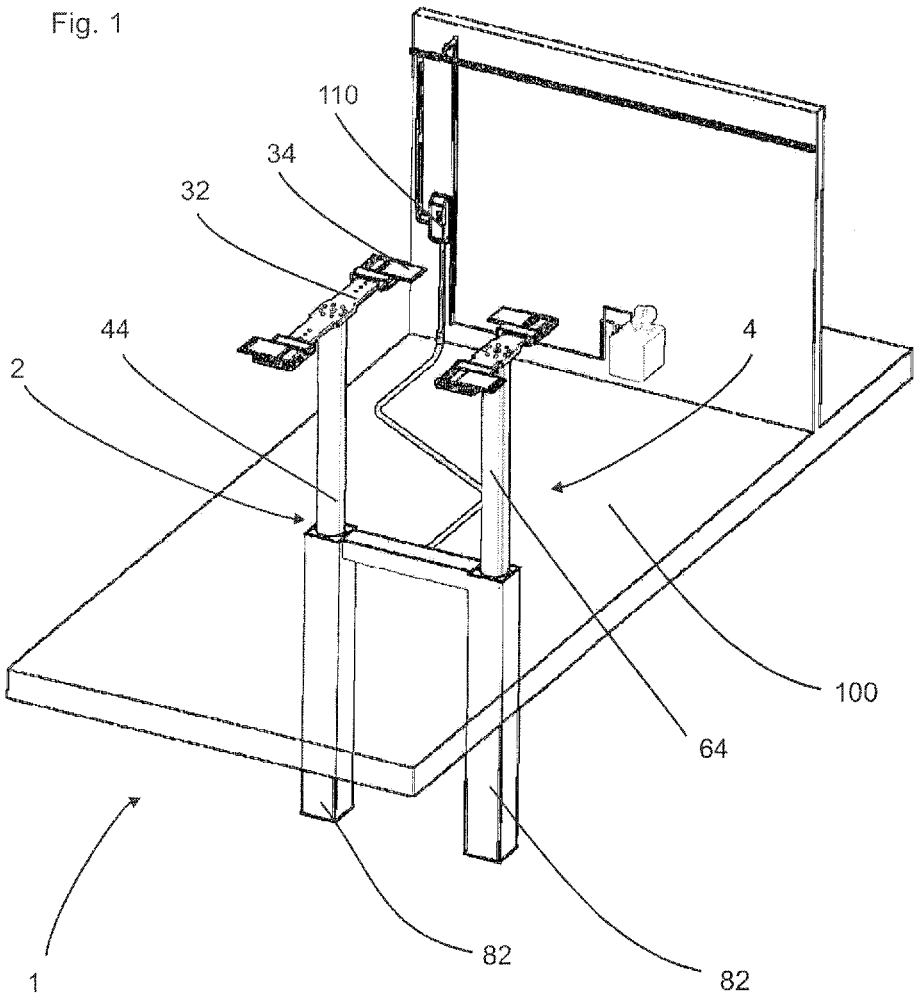
FIG. 1 is an illustration of an underfloor lifting platform according to the invention.

FIG. 1 shows a lifting platform 1 according to the invention, here in the manner of an underfloor lifting platform. In this case the reference number 100 refers to the floor or a floor level respectively. Two housings 82, inside which the lifting devices 2, 4 or the lifting elements 44, 64 respectively are provided, are arranged below the floor. Carrying arms 32 are arranged on the lifting devices 2, 4 in each case, and support elements 34, which can be attached to the vehicle to be lifted, are in turn arranged on the carrying arms 32. The reference number 110 designates a switching device by which the supply of an hydraulic medium to the two lifting devices 2, 4 can be controlled in order to initiate lifting and lowering of the lifting elements for example in this way.

Figure 2:
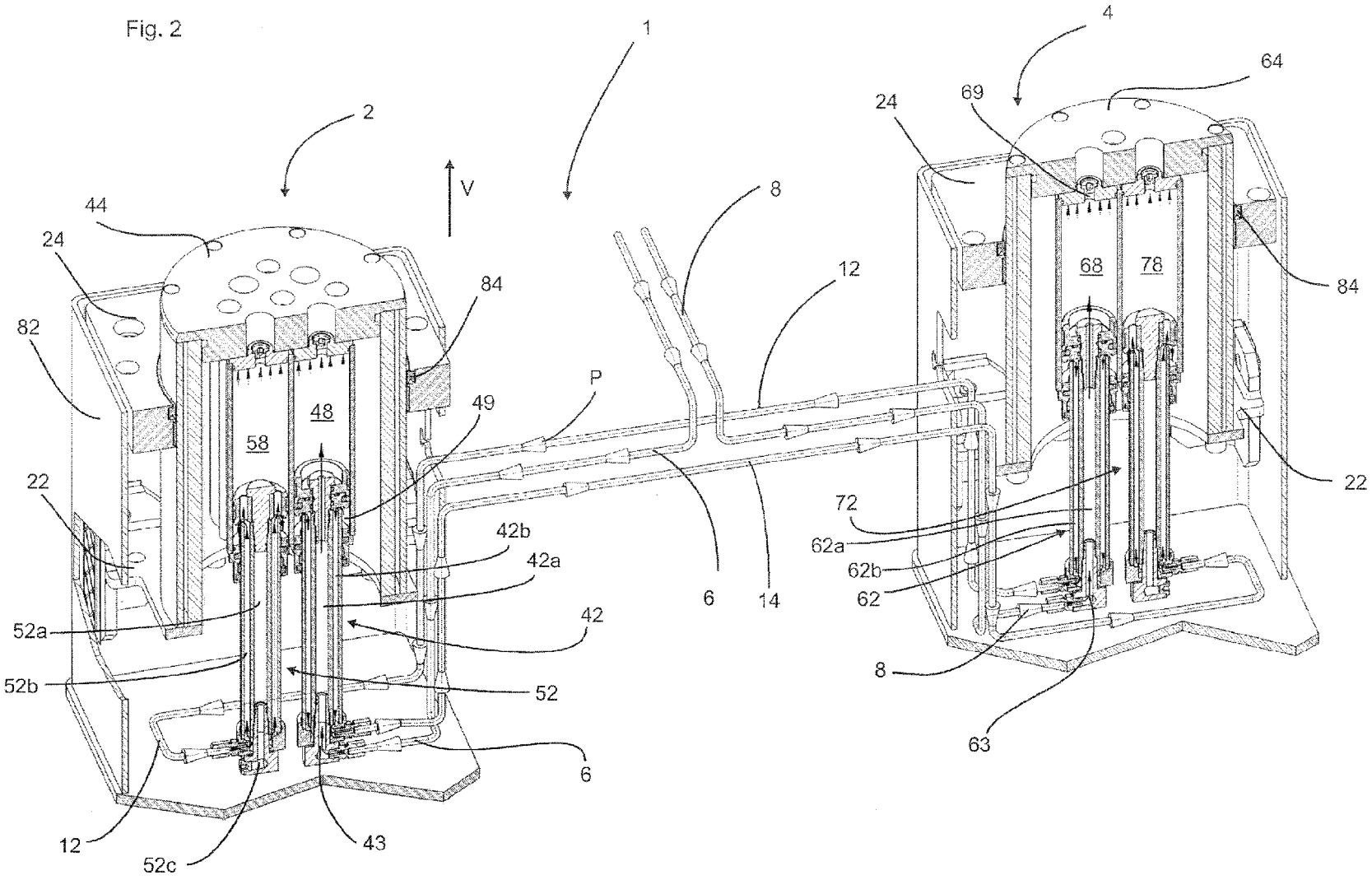
FIG. 2 is a more detailed illustration to demonstrate the manner of operation of the apparatus according to the invention.

FIG. 2 is a more detailed illustration of a lifting platform according to the invention. In this case the lifting devices 2 and 4, which are designed in a substantially similar or symmetrical manner with respect to each other here, are again shown here. The reference numbers 6 and 8 refer to supply lines, the supply line 6 supplying the hydraulic medium to the lifting device 2 and the supply line 8 supplying it to the lifting device 4. Arrow symbols which indicate a direction of flow of an hydraulic medium (for example oil or water) present in the supply lines are attached to these supply lines. The direction of the arrows shown refers to a lifting procedure. The reference letter V refers to the (vertical) direction of movement.

The two lifting devices have in this case supply elements 42, 52 and 62, 72 respectively which are arranged so as to be stationary in each case. A duct 42*a*, by way of which the hydraulic medium can be conveyed into a space 48, is provided in this case inside the supply element 42. The supply element 52 likewise has a duct 52*a*, but here an egress of hydraulic medium is prevented by a closure 52*c*. The reference 42*b* refers to a further duct which is formed in a supply element. A corresponding second duct 52*b* is also formed in a supply element 52.

The reference number 44 and the reference number 64 respectively designate in each case the lifting elements which can be lifted and lowered in the vertical direction in this case and on which are arranged the arms 32 shown in FIG. 1. These lifting elements 44, 64 in this case surround the two supply elements 42 and 52, and 62 and 72 respectively, preferably over the entire preferably thereof. The reference numbers 48 and 58 refer to a space which can be filled with the hydraulic medium in order to lift the lifting element 44, 64 in this way.

The reference number 82 designates a housing which is likewise arranged so as to be stationary and with respect to which the respective lifting elements 44 and 64 are movable. The reference number 84 designates a sealing device for sealing off this movement.

The reference number 24 designates a guide device which guides the movement of the lifting element. The reference number 22 designates a further guide device which in this case, however, is arranged in a fixed manner, for example screwed, on the lifting element. The guide device 24 is arranged in a fixed manner on the housing 82 in this case and is thus stationary. The further guide device 22 is arranged on the lifting element 44 and moves with the latter during the lifting procedure. This further guide device 22 at the same time provides a prevention of rotation which prevents rotation of the lifting element 44 with respect to the housing 82. The operation of the apparatus will now be explained with reference to the lifting device 2. This lifting device 2 is supplied with an hydraulic medium by way of the supply line 6. This hydraulic medium first arrives in the duct 42*a* and then in the space 48. In this region it has the effect that the lifting element 44 is raised. On account of this lifting procedure the space 49 between the supply element 42 and the lifting element 44 is reduced at the same time. In this way, the hydraulic medium is pressed through the second duct 42*b* and arrives at the second lifting device 4 by way of a connecting line 14. In a corresponding manner, hydraulic medium passes from the second lifting device 4 to the first lifting device 2 by way of the supply line 12. This hydraulic medium is supplied in this case to the supply element 52 and arrives in this case in the outer duct 52*a*. The hydraulic medium likewise arrives in the space 58 by way of this outer duct, so that a raising of the lifting element is also carried out as a result. On account of the closure 52*c* it is not possible for the hydraulic medium to flow out. In a corresponding manner, the hydraulic medium arriving at the lifting device 4 by way of the supply line 14, or the connecting line 14 respectively, also causes the hydraulic medium to be supplied into the space 78.

The reference number 69 designates an opening by way of which an aeration of the system can be carried out.

Figure 3:
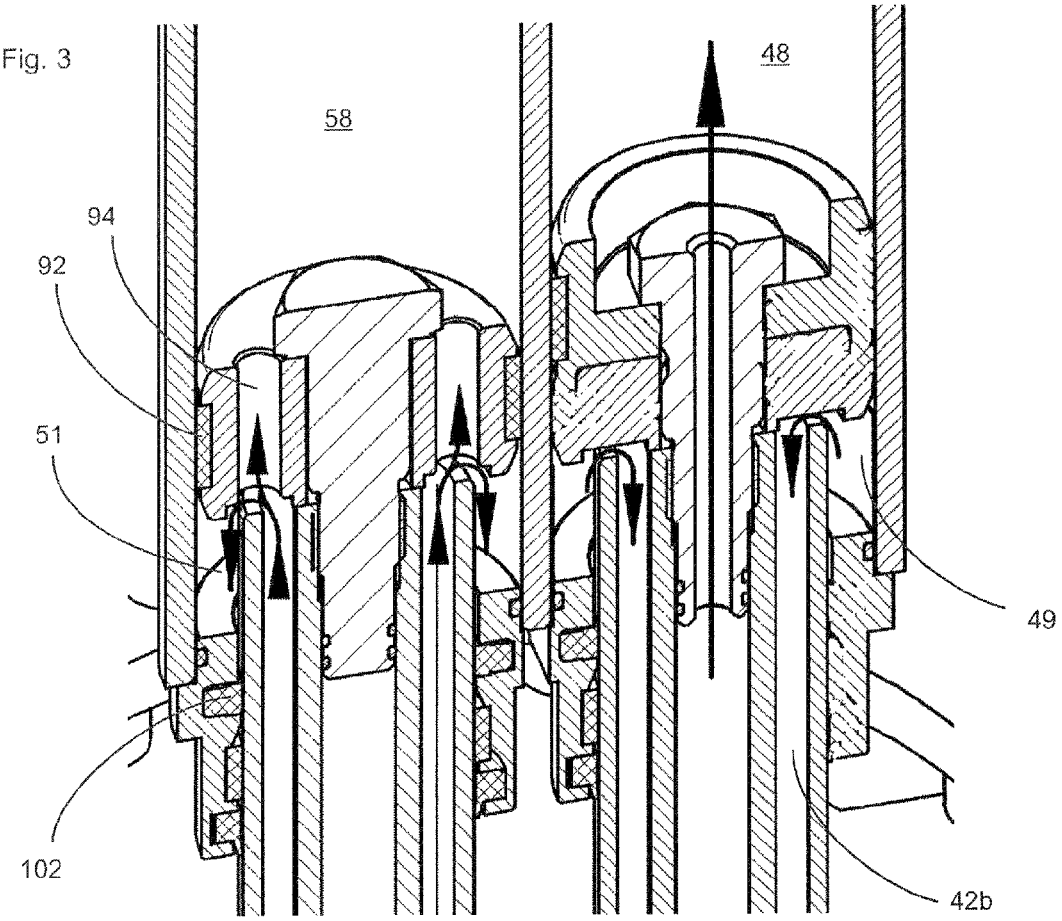
FIG. 3 is a detailed illustration of the illustration from FIG. 2.

FIG. 3 is a detailed illustration of the apparatus shown in FIG. 2. In this case the connecting ducts 94 may be seen, by way of which the hydraulic medium can arrive in the space 58. Furthermore, the hydraulic medium can also pass the lateral guide elements 92 and also arrive in the space 58 from the space 51 in this way.

The reference number 102 designates a sealing device which seals the lifting element 44 off from the supply element 52. The reference number 49 designates the space which is reduced during the lifting procedure and which causes the hydraulic medium to flow back through the line 42*b*.

Figure 4:
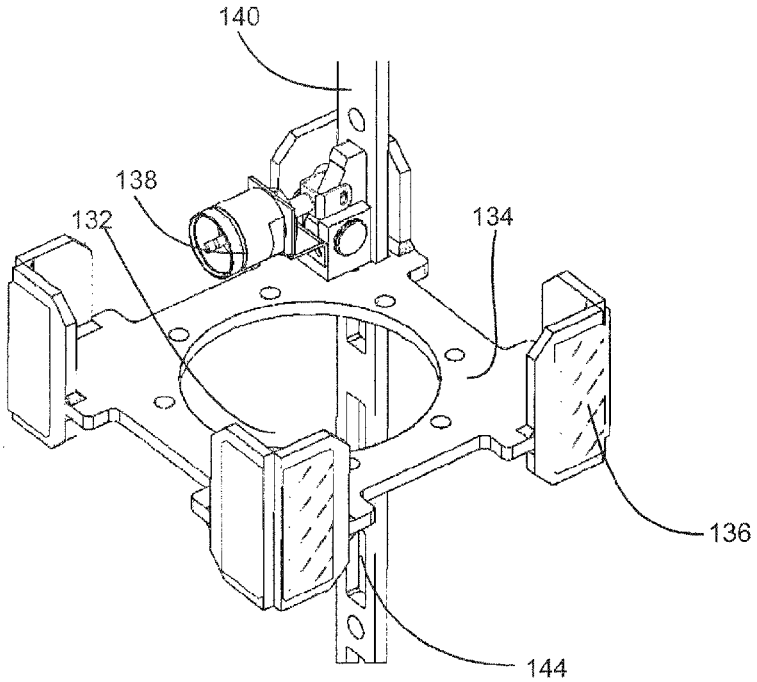
FIG. 4 is an illustration of a securing mechanism for a lifting platform according to the invention.

FIG. 4 is an illustration of a securing mechanism. In this case an opening 132 is provided here through which the lifting element 44 can extend and on which the lifting element is arranged. A carrier 134 with a square (generally polygonal) cross-section in this case, in general a cross-section differing from a circular shape, is present at this opening. The reference numbers 136 refer to guide devices (such as for example sliding apparatus) which engage on an inner wall of the housing 82 shown in FIG. 2 and are movable with respect to this inner wall.

The reference number 138 designates a locking element which can be supplied pneumatically and which can stop the movement of the lifting platform. To this end an engagement means 142 can engage in corresponding openings 144 in a locking rod 140 and can thus prevent movement. As mentioned, this locking element 138 is advantageously supplied hydraulically or pneumatically, so that in this way an improved securing opportunity is provided.

Figure 5:
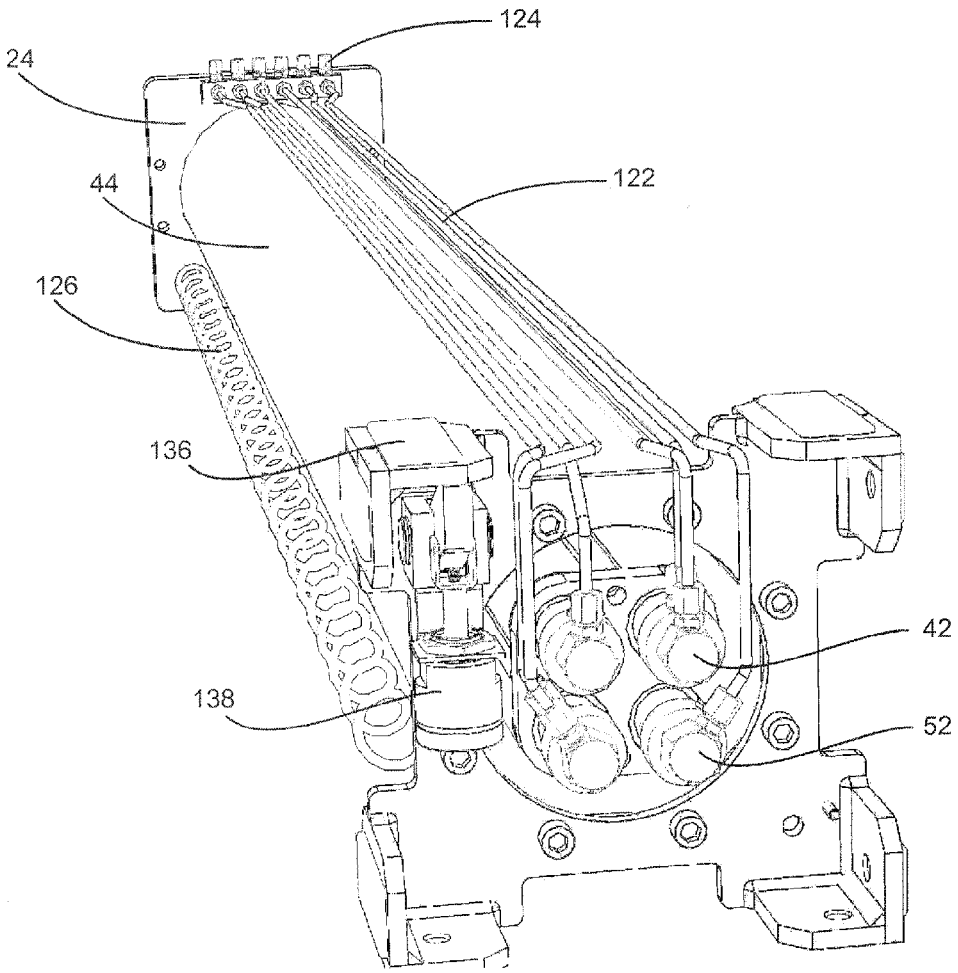
FIG. 5 is an illustration of a lifting device.

FIG. 5 is a further illustration of a lifting device according to the invention. In this case too, the lateral guide elements 136 are again provided which can slide with respect to the inner wall of the housing 82, as well as also the drive device which is used for locking. In contrast to the embodiment shown in FIG. 2, however, in this case it is not two supply elements that are provided but altogether four supply elements, two further supply elements serving as redundant systems in each case.

The reference numbers 124 refer to attachment devices in order to supply the hydraulic medium, and the reference number 122 refers to lines which supply the hydraulic medium to the supply elements 42, 52. The reference number 126 designates a resilient line for the air supply of the locking device.

Figure 6:
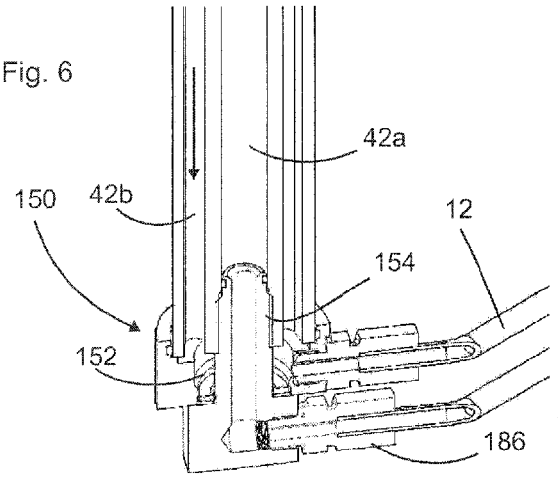
FIG. 6 is a detail to demonstrate the fluid supply for a lifting device.

FIG. 6 is a more detailed illustration of the supply of an hydraulic medium into the supply element 42. It will be seen that the medium for lifting the motor vehicle flows upwards in the central duct 42*a*, whilst it flows downwards in the ducts 42*b* and can flow out in turn by way of a line 12. In these areas valve elements (not shown in detail) can be provided which can control the through-flow of the medium or switch it off or on respectively.

The reference number 150 designates a carrier on which is arranged the supply element 42. This carrier 150 has a cavity 152 into which the hydraulic medium can flow in order to be connected in terms of flow to the connecting line 12. In addition, a slide-in element 154 is provided which is capable of being introduced into the supply element 42 in order to produce a flow connection between the duct 42*a* and the supply line 6. The reference number 156 designates a connecting member.

It will be seen that in the case of the supply elements on the right in each case a reverse flow of the hydraulic medium downwards is not possible or is blocked respectively, as demonstrated in FIG. 2 by the closure elements 52*c*.

Figure 7:
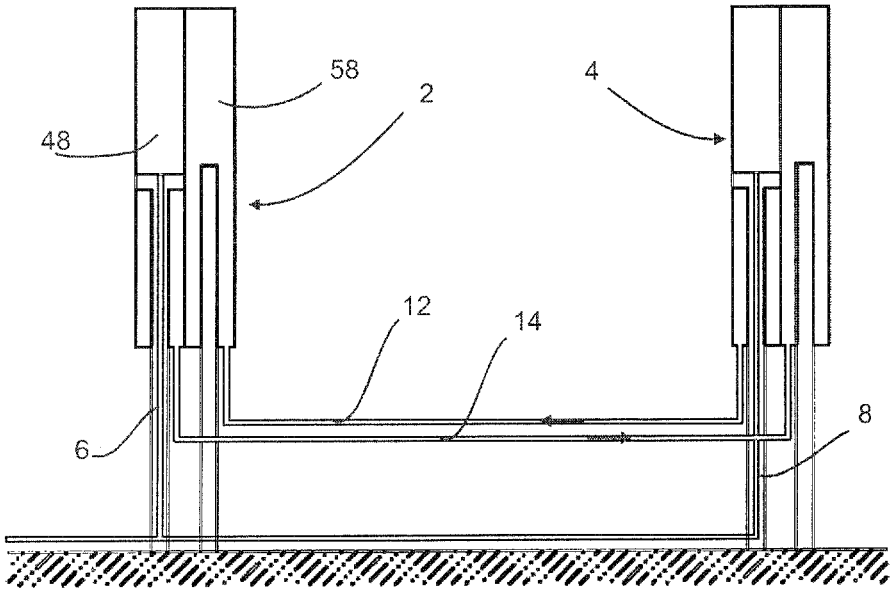
FIG. 7 is a diagrammatic illustration to demonstrate the present invention.

FIG. 7 is a roughly diagrammatic illustration of the principle underlying the invention. In this case too, the two lifting devices 2, 4 are provided, which are supplied with the hydraulic medium by the supply lines 6 and 8. In addition, the two connecting lines between the lifting devices 2, 4 or the supply elements thereof respectively are also illustrated.

Figure 8:
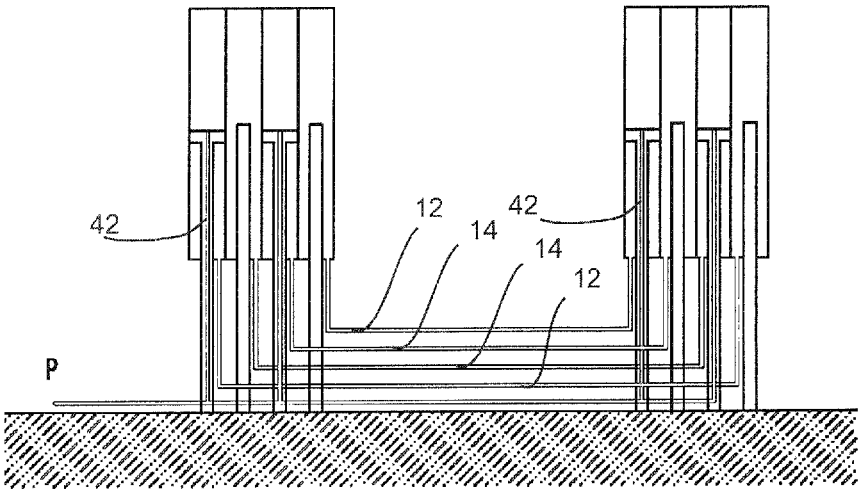
FIG. 8 is a further diagrammatic illustration to demonstrate the invention.

FIG. 8 shows a further design, in which case the supply elements shown in FIG. 7 are present in a redundant manner, i.e. the supply of the hydraulic medium is carried out by way of two supply elements and the removal is likewise carried out by way of two supply elements. In a corresponding manner, two connecting lines 12 and two connecting lines 14 are also provided here. This embodiment is advantageous, in particular, for lifting heavy loads, such as for example HGVs, in which case the hydraulic medium is supplied parallel to the two supply elements 42.

Figure 9:
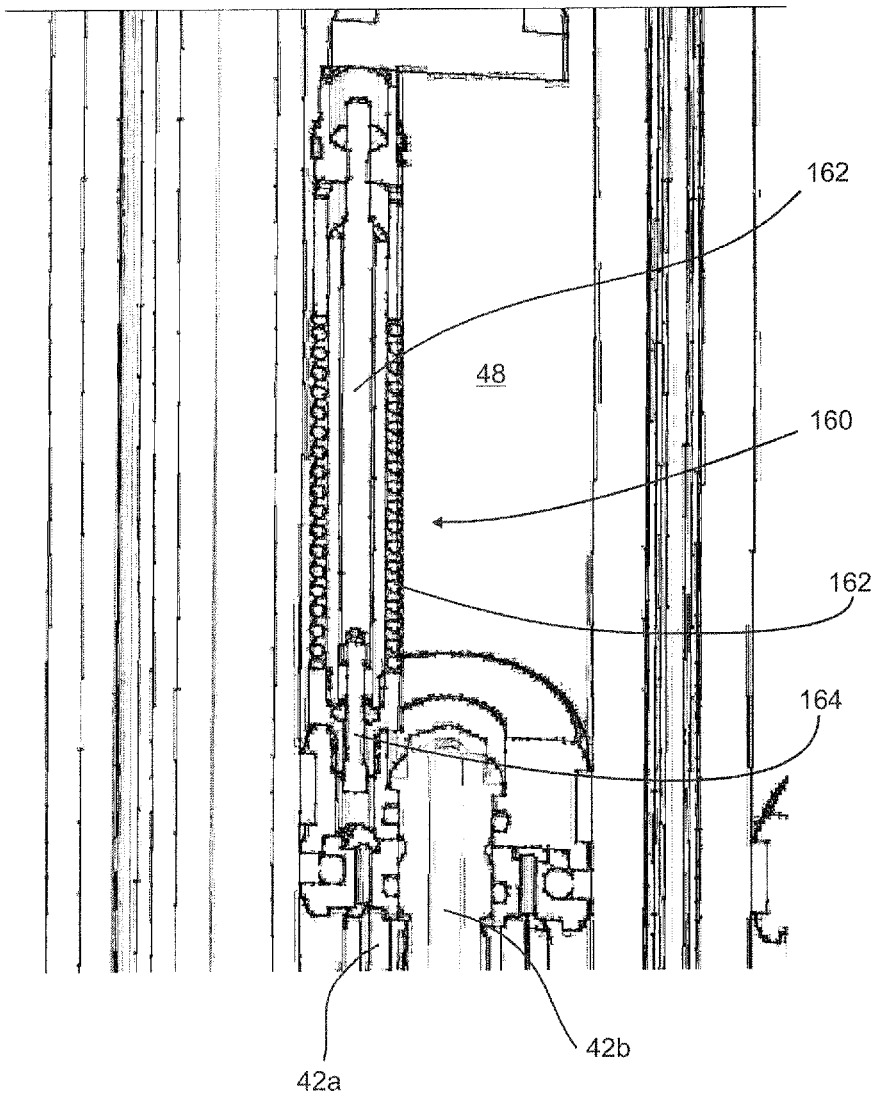
FIG. 9 is an illustration to demonstrate an aeration valve.

FIG. 9 is a further illustration of a lifting device. It will be seen that a fan device, more precisely an aeration valve 160, is arranged in this case between the upper end of the supply element 42 and the upper boundary of the space 48. This aeration valve is used here to aerate the duct 42*b* of the supply element.

The aeration valve 160 has a valve body 164 which is used for opening and closing the valve. In addition, the aeration valve 160 has a spring device 162 which causes the valve 160 to be opened when the lifting element 44 is lowered, so that for example air present in the duct can be removed. For this purpose, the aeration valve 160 also has a duct 166 by way of which air can be removed through the space 48—but sealed off with respect to the latter—out of the apparatus.

In this way, aeration of the duct 42*b*—which is accessible with difficulty—is also possible. It is also possible, however, for aeration valves for the aeration of further ducts of the lifting device to be provided.

The Applicants reserve the right to claim all the features disclosed in the application documents as being essential to the invention, insofar as they are novel either individually or in combination as compared with the prior art.

LIST OF REFERENCES

1 apparatus
2, 4 lifting devices
6, 8 supply lines
12 supply line
14 connecting line
22 further guide device
24 guide device
32 carrying arms
34 support elements
42, 52 supply elements
42*a*, 52*a* duct
42*b*, 52*b* second duct
44 lifting element
48 space
49 space
51 space
52*c* closure
58 space
62 supply element
62*a* duct
64 lifting element
69 opening
72 supply element
78 space
82 housing
84 sealing device
92 lateral guide elements
94 connecting ducts
100 floor/floor level
102 sealing device
110 switch device
122 lines
124 attachment devices
132 opening
134 carrier
136 guide device
138 locking element
140 locking rod
142 engagement means
144 openings
150 carrier
152 cavity
154 slide-in element
156 connecting member
160 aeration valve
162 spring device
164 valve body
166 aeration duct

The invention claimed is:

1. An apparatus for lifting motor vehicles, said apparatus comprising a first lifting device which is movable in a vertical direction and which is suitable for supporting a first region of the motor vehicle to be lifted, with a second lifting device which is arranged at a distance from the first lifting device and which is suitable for supporting a second region of the motor vehicle to be lifted, with a first supply line which supplies an hydraulic medium to the first lifting device, and with a second supply line which supplies an hydraulic medium to the second lifting device, wherein the first lifting device has a first supply element arranged in a stationary manner for supplying the hydraulic medium, wherein this first supply element extends at least locally in the vertical direction, wherein this supply element has a first duct for conveying the hydraulic medium, wherein the first lifting device additionally has a first lifting element which extends in the vertical direction (V) and which is movable with respect to the first supply element in this vertical direction (V), wherein the second lifting device has a first supply element arranged so as to be stationary for supplying an hydraulic medium, wherein this first supply element of the second lifting device extends at least locally in the vertical direction and wherein this second supply element also has a first duct for conveying the hydraulic medium, and wherein the second lifting device additionally has a first lifting element which extends in the vertical direction (V) and which is movable with respect to the first supply element in this vertical direction, and with a first connecting line which forms a direct flow connection for the hydraulic medium between the first lifting device and the second lifting device.

2. The apparatus according to claim 1, wherein the apparatus is provided with valve devices which control fluid communication with the lifting device and/or between the first and second lifting devices.

3. The apparatus according to claim 1, wherein the first connecting line is used to effect a coupling of movements of the first lifting device and the second lifting device.

4. The apparatus according to claim 3, wherein the first and second connecting lines are provided between the first and second lifting devices.

5. The apparatus according to claim 3, wherein a drive between the first and second lifting devices acts in advance as a whole as a master/slave device, in which one of the first and second lifting devices pre-sets a movement and the other lifting devices follows this movement.

6. The apparatus according to claim 1, wherein the apparatus further includes a second connecting line which forms a flow connection for the hydraulic medium between the first lifting device and the second lifting device.

7. The apparatus according to claim 1, wherein at least one supply element has a supply opening for supplying the hydraulic medium to the supply element, wherein the supply opening is arranged in a lower half of the supply element.

8. The apparatus according to claim 7, wherein the supply opening is arranged in a lower third, preferably in a lower quarter, and most preferably in a lower fifth of the supply element.

9. The apparatus according to claim 1, wherein the supply element is arranged inside the lifting element associated with it.

10. The apparatus according to claim 1, wherein a second liquid duct for conveying the hydraulic medium is arranged in at least one supply element.

11. The apparatus according to claim 10, wherein the hydraulic medium is capable of being conveyed in the first liquid duct and the second liquid duct in different directions of flow.

12. The apparatus according to claim 11, wherein the two directions are opposed conveying directions.

13. The apparatus according to claim 12, wherein the two directions are vertical directions in each case.

14. The apparatus according to claim 1, wherein a plurality of first supply elements are provided, which are provided inside a lifting element.

15. The apparatus according to claim 14, wherein two of the plurality of supply elements are connected in series with respect to the direction of flow of the hydraulic medium.

16. The apparatus according to claim 14, wherein two of the plurality of supply elements are connected in parallel with respect to the direction of flow of the hydraulic medium.

17. A lifting device for a lifting platform, said lifting device having a first supply element for supplying a hydraulic medium to the lifting device, wherein the first supply element extends at least locally in a straight direction and has a first duct for conveying the hydraulic medium, said lifting device further having a first lifting element which likewise extends in said straight direction and which is movable with respect to the first supply element in said straight direction, wherein the first supply element has a first connection for supplying the hydraulic medium to the first duct, and wherein the supply element is arranged at least locally inside the lifting element, wherein the first supply element has a second duct for conveying the hydraulic medium, wherein the second duct is separate from the first duct and the lifting device is designed such that the hydraulic medium is capable of being conveyed in opposite directions of flow in the first and second ducts, and wherein the lifting device has a housing, inside which the lifting element is arranged, wherein a first guide device is further provided in order to guide the movement of the lifting element with respect to the housing as well as a second guide device in order to guide movement of the lifting element with respect to the housing.

18. The lifting device according to claim 17, wherein the first and second guide devices are arranged at a distance from one other in the direction of movement of the lifting element with respect to the housing.

19. The lifting device according to claim 17, wherein at least one of said first and second guide devices is also designed in a form of a rotation preventor, which prevents rotation of the lifting element with respect to the housing.

20. The lifting device according to claim 17, wherein at least one of said first and second guide devices has a braking and/or blocking element which brakes and/or blocks a relative movement of the lifting element with respect to the supply element.

21. A lifting device according to claim 17, wherein at least one of the first and second the lifting device has at least one second supply element which extends parallel to the first supply element and is arranged inside the lifting element.

* * * * *